US005472623A

United States Patent [19]

Doi et al.

[11] Patent Number: 5,472,623

[45] Date of Patent: Dec. 5, 1995

[54] FINISH FOR POLYAMIDE YARN

[75] Inventors: Tetsuo Doi, Nara; Toshimoto Furuichi, Yamatokoriyama; Takeshi Munekiyo, Yao, all of Japan

[73] Assignee: Matsumoto Yushi-Seiyaku Co., Ltd., Osaka, Japan

[21] Appl. No.: 328,017

[22] Filed: Oct. 24, 1994

[51] Int. Cl.[6] ..... D06M 13/402

[52] U.S. Cl. ..... 252/8.8; 252/8.6; 252/8.7; 252/8.75; 252/8.9; 8/115.6

[58] Field of Search ..... 252/8.6, 8.8, 8.9, 252/8.7, 8.75; 8/115.6

[56] References Cited

U.S. PATENT DOCUMENTS

| | | | |
|---|---|---|---|
| 3,983,061 | 9/1976 | Oxe et al. | 252/8.8 |
| 4,129,507 | 12/1978 | Marshall et al. | 252/8.9 |
| 4,134,839 | 1/1979 | Marshall | 252/8.6 |
| 4,283,292 | 8/1981 | Marshall et al. | 252/8.8 |
| 4,606,972 | 8/1986 | Marshall | 428/395 |

FOREIGN PATENT DOCUMENTS

| | | |
|---|---|---|
| 2-293474 | 12/1990 | Japan . |

*Primary Examiner*—Anthony Green
*Attorney, Agent, or Firm*—Stevens, Davis, Miller & Mosher

[57] ABSTRACT

A finish for polyamide yarn comprising 0.2 to 10 weight percent of an amide of polyamine and $C_{12}$–$C_{50}$ aliphatic dibasic acid, or an alkali metal salt of the said amide, functioning to prevent the oligomer in polyamide yarn from being extracted out on the polyamide yarn surface during storage so as to prevent fluffs and yarn breakage due to scum generation in down-stream process.

4 Claims, 1 Drawing Sheet

FINISH FOR POLYAMIDE YARN

BACKGROUND OF THE INVENTION

The present invention relates to the finish for polyamide yarn. The finish of the invention comprises ingredients, which function to prevent oligomer extraction from the interior of polyamide yarn during storage, base components, and additives.

Polyamide yarn stored at high temperature and humidity for a long time sometimes causes fluffs or yarn breakage, in down-stream processes such as, twisting, texturing, warping, sizing, weaving, and knitting, due to high friction at yarn-to-machinery interface and fluctuated yarn tension by the said high friction.

The high friction at yarn-to-machinery interface is caused by the scum deposited on the surface of machine parts such as, guides, rolls, combs, or needles. The scum comprises the oligomer extracted from the inside to the surface of polyamide-yarn by the moisture which has penetrated into the polyamide yarn through the uncrystallized part of the polyamide yarn during long-term storage especially under high temperature and humidity.

Finishes for polyamide yarn are applied in neat, solvent dilution, or 5–30% aqueous emulsion in spinning process. And finish-applied yarn is taken up into packages in spin-draw system, where finish-applied yarn is drawn between 1st and 2nd godet rolls at a fixed draw ratio, or in highly-oriented yarn (HOY) production system, where finish-applied yarn is not drawn before take-up.

Recently the spinning speed of polyamide yarn has been increased for better cost performance. Increased spinning speed accelerates the above-mentioned loosening of polymer orientation at the uncrystallized part of polyamide yarn, and thus increases the moisture penetrating into polyamide yarn through the said uncrystallized part.

Increased moisture penetrated into polyamide yarn increases the oligomer extraction out on yarn surface, and thus leads to the increase of fluffs and yarn breakage in down-stream process due to scum generation.

The finish of the present invention will prevent the oligomer extraction from the interior to the surface of polyamide yarn, and will minimize or eliminate troubles in the down-stream process, i.e., fluffs and yarn breakage.

SUMMARY OF THE INVENTION

A finish for polyamide yarn functioning to prevent the oligomer extraction from the interior of polyamide yarn so as to maintain sufficient processability in the said down-stream processes after long-time storage is formulated by blending 0.2 to 10 weight percent of an amide of polyamine and $C_{12}$–$C_{50}$ aliphatic dibasic acid, or an alkali metal salt of the said amide in a conventional finish formula.

DETAILED DESCRIPTION OF THE INVENTION

Figure 1:
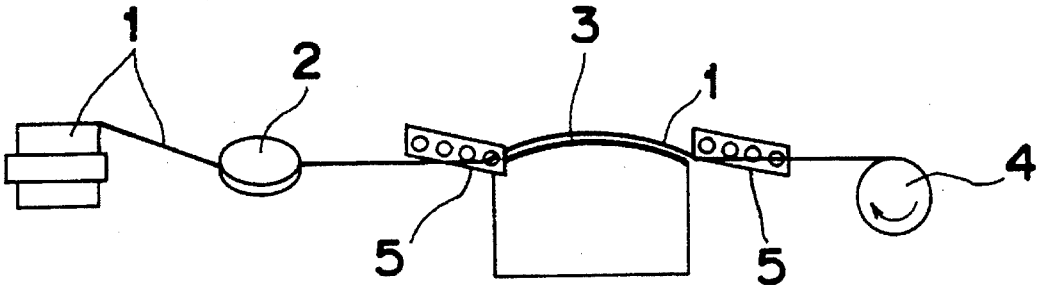
FIG. 1 is a schematic view of a device used for determination of the scum in the Examples 1–4.

The present invention relates to a finish for polyamide yarn comprising amides of polyamines and $C_{12}$–$C_{50}$ aliphatic dibasic acids or alkali metal salts thereof in the amount of 0.2 to 10% by weight based on total amount of the finish.

A finish containing an amide of polyamine and $C_{12}$–$C_{50}$ aliphatic dibasic acid, or an alkali metal salt of the said amide, when applied to polyamide yarn, prevents the oligomer of polyamide yarn from being extracted out on the polyamide yarn surface, so as to prevent fluffs or yarn breakage in the down-stream processes such as, twisting, texturing, warping, weaving, and knitting.

The polyamine of the present invention is selected among aliphatic polyamines having alkylene groups of 2 or more carbon atoms; that is, alkylenediamines such as, ethylenediamine, trimethylenediamine, hexamethylenediamine, dodecandiamine, and the like; polyalkylene polyamines having amino groups in their alkylene chains such as, diethylenetriamine, triethylenetetramine, pentaethylnehexamnine, and the like; oligoethyleneimines; and polyethylneimines. Aromatic amines such as, phenylenediamine, can also be selected, and blended partially in the said polyamines less than 10 percent by weight of the total amount of the polyamine. The optimum polyamines of the present invention are $C_2$–$C_{20}$ aliphatic diamines, preferably $C_3$–$C_{10}$ aliphatic diamines, which may have branches such as, methyl or ethyl groups or double bonds.

The aliphatic dibasic acid of the present invention is selected among $C_{12}$–$C_{50}$ aliphatic dibasic acids; that is, alkylene dicarboxilic acids such as, dodecamethylene dicarboxilic acid, octadecamethylene dicarboxilic acid, and the like; alkenyl succinic acids such as, dodecenyl succinic acid, octadecenyl succinic acid, and the like; and dimer acids of unsaturated fatty acids such as, linoleic acid. The most preferable are the dibasic acids of relatively high molecular weight such as, a dimer acid of unsaturated fatty acid of 18 or more carbon atoms, of which preferable molecular weight is from 500 to 1000. The combination of two or more of those dibasic acid is also applicable.

The preferable molecular weight of the amide of a polyamine and $C_{12}$–$C_{50}$ aliphatic dibasic acid, or the alkali metal salt of the said amide is from 500 to 4000, more preferably from 700 to 3000. The molecular weight of the said amide can be controlled within the range through reacting the amine with the dibasic acid, added in stoichiometrically excessive quantity, at 80° to 200° C. in a known manner to bond carboxylic groups to at least one end, preferably to both ends, of polymer chain of the resultant amide. The preferable ratio between the amine and the dibasic acid is from 1:3 to 1:10, for minimizing the generation of amide of higher molecular weight than the above preferable range, and for attaining sufficient compatibility to finish components of the resultant amide.

The preferable ratio of the components of the present invention in finish formula is from 0.2 to 10 weight percent, more preferably from 1 to 8 weight percent based on the total weight of the finish. The ratio below the said range cannot sufficiently prevent the oligomer extraction, and the ratio above the said range leads to poor compatibility between the said components and other finish components, and also to poor lubricity of the finish.

The finish components blended with the oligomer-extraction preventive components of the present invention are; lubricant selected among mineral oil and esters such as, isooctylpalmitate, tridecylstearate, oleyloleate, dioleyladipate, 1,6-hexanediol dioleate, coconut oil, rapeseed oil, or POE alkylether laurate; nonionic surfactants such as, among PO/EO polyether, POE synthetic alcohol ether, POE oleylether, PEG monooleate, POE castor wax ether, and POE laulylaminoether; amphoteric surfactants such as, alkyl N-carboxyethoxyethyl-N-carboxyethylimidazolinium hydroxide; anionic surfactants such as, sodium alkylsulfonate, alkyl-phosphate amine salt, or dioctylsulfosuccinate; and additives such as, silicone derivatives, antioxidants, and the additives for lowering the phase-inversion viscosity of finishes.

The finish of the present invention can be applied on polyamide yarn in neat, dilution with solvent, or 10–30% aqueous emulsion, with kiss-roll application or metering-pump application, at 0.3–1.5 percent of yarn weight.

The preferable finish formulation for each form of application is presented below in weight percent.

| | Neat | Solvent dilution | Aqueous emulsion |
|---|---|---|---|
| Polyamide of present invention | 1–5 | 1–5 | 0.2–1.0 |
| Lubricant | 60–90 | 25–45 | 5–7 |
| Nonionic surfactant | 5–10 | 5–10 | 0.5–1.5 |
| Amphoteric surfactant | — | — | 0–1.0 |
| Anionic surfactant | 0–3 | 0–5 | 0.5–1.0 |
| Compatibility improver | 2–10 | 0–10 | 0–10 |
| Solvent | — | 40–80 | — |
| Water | — | — | 70–90 |

The present invention will be further illustrated by the following examples of application, although these examples are included merely for purposes of illustration and are not intended to limit the scope of the invention.

EXAMPLES 1–4

The finish formulae of the present invention 1–4, and the comparative finish formulae 1–3, which are summarized in Table 1, were prepared into 10% aqueous emulsion. A nylon 66 yarn of 20 denier 10 filament was produced continuously for ten days with the finish emulsions of the examples 1–4 and the comparative finish formulae at a targeted application of 1.0% on the weight of the yarn in metering finish application.

The yarn was taken up in spin-draw system at 5000 m/min. with a 1st godet roll, of which temperature was controlled at room temperature, and a 2nd godet roll, of which temperature was controlled at 160° C.

The fume generated in the said process, the stain on the 2nd godet roll, fluffs, yarn breakage, and the scum generated from the yarn after treated in accelerated aging under 50° C. and 90% RH for 2 weeks were tested by the following methods.

a. Fume

The fume pooled in the box, which was fixed around the 2nd godet roll (at 160° C.) was observed.

b. Stain on 2nd godet roll

The stain on the 2nd godet roll was observed after the 10-day continuous yarn production.

c. Fluffs

The number of fluffs appearing on 100,000,000 m of yarns applied with each of the prepared finish emulsion were counted with a fluff counter. The result was calculated into the number per 1000,000 m of yarn.

d. Yarn breakage

The total number of yarn breakage throughout the 10-day continuous production was calculated into the average number per day.

e. Scum from yarn after accerelated aging treatment

The yarns produced in the 10-day continuous trial were stored at 50° C. and 90% RH for 2 weeks. The yarn 1 after the accerelated aging treatment was driven through a washer tensioner 2 on a friction device, in which a piece of black velvet 3 is placed for detecting scum from a yarn sample, as illustrated FIG. 1.

The yarns were passed through two ceramic eyelet 5 placed on the both sides of the black velvet 3 so as to contact therewith at 200 m/min. for 10 minutes by a take-up 4.

The scum accumulated on the velvet was observed with naked eyes and evaluated.

TABLE 1

| | Examples of the present invention | | | | Comparatives | | |
|---|---|---|---|---|---|---|---|
| | 1 | 2 | 3 | 4 | 1 | 2 | 3 |
| Tridecyl stearate | 60 | 60 | 60 | 60 | 60 | 50 | 60 |
| Diglicerin dioleate | 8 | 5 | 7 | 3 | 10 | 3 | 3 |
| POE oleyl ether*1 | 17 | 17 | 17 | 14 | 17 | 14 | 12 |
| POE castor wax*1 | 6 | 6 | 6 | 6 | 6 | 6 | 6 |
| Oleyl phosphate amine salt | 4 | 4 | 4 | 4 | 4 | 4 | 4 |
| Sodium alkyl sulfonate | 3 | 3 | 3 | 3 | 3 | 3 | 3 |
| Amide K salt of Hexamethylene diamine/ Dimer acid (¼)*2 | 2 | — | — | — | — | — | — |
| Amide of Hexamethylene diamine/ Dimer acid (⅙)*2 | — | 5 | — | — | — | 20 | — |
| Amide of Ethylene diamine/ Dimer acid (⅙)*2 | — | — | 3 | — | — | — | 12 |
| Amide of Hexa-methylene diamine/Octadecenyl succinic acid (⅚)*2 | — | — | — | 10 | — | — | — |
| Thermal stability | | | | | | | |
| Fume*3 | o | o | o | o | o | o | o |
| Roller deposit*3 | o | o | o | o–Δ | o | x | Δ |
| Spinnability | | | | | | | |
| Yarn breakage per day | 0.8 | 1.0 | 0.3 | 1.5 | 0.7 | 15 | 10 |
| Fluffs per 1000,000 m | 0.02 | 0.03 | 0.01 | 0.05 | 0.03 | 5.0 | 1.8 |
| Scum after 2 weeks aging at 50° C. and 90% RH*3 | o | o | o | Δ | x | o | o |

*1: The POE means polyoxyethylene.
*2: The ratio in the parentheses is the molar ratio for reaction. The dimer acid is $C_{18}$-unsaturated fatty acid dimer.
*3: The marks for the thermal stability and the scum mean, o little, Δ a little, and x much.

EXAMPLES 5–8

The finish formulae of the present invention 5–8, and the comparative finish formulae 4–7, which are summarized in Table 2, were formulated. Those finishes were applied in neat to nylon 6 friction-textured yarn of 30 denier 5 filament in kiss-roll application at 1.3% on the weight of the yarn. And the finish-applied yarns were taken up on cones. The parts of those finish-applied yarns were aged under 50° C. and 90% RH for two weeks.

The yarn-to-metal friction of the finish-applied yarns, and the aged yarns was determined in the method described below. And the scum generated from the said aged yarns were determined in the method mentioned at e. in the illustration of Examples 1–4.

a. Yarn-to-metal friction

Figure 2:
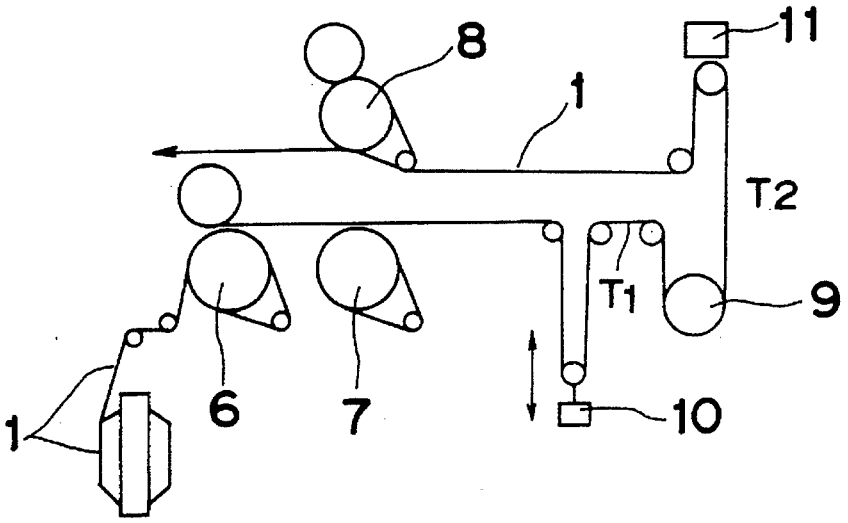
FIG. 2 is a diagram illustrating the determination of yarn-to-metal friction.

The yarn-to-metal friction of the finish-applied yarns, and the aged yarns was determined with the device illustrated in FIG. 2.

The yarn 1 was fed by feeder roll 6, sent by a heater roll 7, and drawn by a draw roll 8 at substantially the same speed. The yarn 1 was slipped on a frictional body 9 which was located between the heater roll 7 and the draw roll 8. A dead load (10 g) 10 was hung on the yarn before the frictional body to input a tension ($T_1$) to the yarn. The tension ($T_2$) of the yarn was determined by a U-gauge after the yarn passed the frictional body 9. The yarn-to-metal frictional coefficient (F/M μd) was calculated by the following equation. The yarns were driven on the device to detect the final yarn tension ($T_2$) which represents the yarn-to-metal friction.

Frictional body: Matte chromium pin, 40 mm dia.

Yarn speed: 200 m/min.

Yarn wrap angle: 180° (π radian)

Input yarn tension: 10 g $$F/M\ \mu d = \frac{1}{\pi} \ln \frac{T_2}{T_1}$$

TABLE 2

| | Examples of the present invention | | | | Comparative examples | | | |
|---|---|---|---|---|---|---|---|---|
| | 5 | 6 | 7 | 8 | 4 | 5 | 6 | 7*1 |
| Iso-octyl laurate | 45 | 45 | 45 | 45 | 45 | 45 | 45 | — |
| Mineral oil (R.W. 60 sec.) | 41 | 40 | 37 | 40 | 42 | 40 | — | — |
| POE alkyl (C12, C14) ether*2 | 5 | 5 | 5 | 5 | 5 | 5 | 5 | — |
| Alkyl phosphate amine salt | 3 | 3 | 3 | 3 | 3 | 3 | 3 | — |
| Oleyl alcohol | 5 | 5 | 5 | 5 | 5 | 5 | 5 | — |
| Dimer acid | — | — | — | — | — | 2 | 2 | — |
| Amide of | 1 | 2 | 5 | — | — | — | 15 | — |

TABLE 2-continued

| | Examples of the present invention | | | | Comparative examples | | | |
|---|---|---|---|---|---|---|---|---|
| | 5 | 6 | 7 | 8 | 4 | 5 | 6 | 7*1 |
| Hexamethylene diamine/ Dimer acid (⅙)*3 | | | | | | | | |
| Amide of Ethylene diamine/ Dimer acid (⅙)*3 | — | — | — | 2 | — | — | — | — |
| F/M μd of Non-aged yarn | 0.198 | 0.200 | 0.210 | 0.201 | 0.198 | 0.200 | 0.230 | 0.267 |
| F/M μd of aged yarn | 0.216 | 0.208 | 0.211 | 0.210 | 0.325 | 0.300 | 0.231 | 0.390 |
| Scum from aged yarn*4 | o–Δ | o | o | o | xx | x | o | xx |

*1: The comparative example 7 is a finish-free yarn sample.
*2: The POE means polyoxyethylene.
*3: The ratio in the parentheses is the molar ratio for reaction. The dimer acid is $C_{18}$-unsaturated fatty acid dimer.
*4: The marks for the scum mean; o little; Δ a little; x much; xx very much.

What is claimed is:

1. A finish for polyamide yarn which comprises 0.2 to 10% by weight of amides obtained from the reaction of diamines and $C_{12}$–$C_{50}$ aliphatic dibasic acids in 1:3 to 1:10 molar ratio, or metal salts thereof.

2. The finish of claim 1, wherein the diamines are $C_3$–$C_{10}$ alkylenediamines.

3. The finish of claim 1, wherein the aliphatic dibasic acids are dimer acids of unsaturated fatty acids of 18 or more carbon atoms.

4. The finish of claim 1, wherein the amide is obtained through the reaction of $C_3$–$C_{10}$ alkylenediamines and dimer acids of unsaturated fatty acids of 18 or more carbon atoms.

* * * * *